United States Patent [19]

Long et al.

[11] Patent Number: 4,471,500

[45] Date of Patent: Sep. 18, 1984

[54] SELF-ROLLING SWIMMING POOL COVER

[76] Inventors: Robert E. Long, 692 Waterloo St., London, Ontario, Canada, N6A 3V9; Eric G. Siegrist, R.R. #2, Wiarton, Ontario, Canada, N0H 2T0

[21] Appl. No.: 293,949

[22] Filed: Aug. 18, 1981

[51] Int. Cl.[3] ..... E04H 3/19

[52] U.S. Cl. ..... 4/499; 4/500; 4/502; 160/41

[58] Field of Search ..... 4/502, 661, 498, 499, 4/500, 503; 160/41; 242/58.6

[56] References Cited

U.S. PATENT DOCUMENTS

| | | | |
|---|---|---|---|
| 3,231,006 | 1/1966 | Fisher et al. | 160/41 |
| 3,916,457 | 11/1975 | Morita | 4/502 |
| 3,927,427 | 12/1975 | Aine | 4/499 |
| 4,103,368 | 8/1978 | Lockshaw | 4/502 |
| 4,324,370 | 4/1982 | Guard et al. | 4/502 |

FOREIGN PATENT DOCUMENTS

| | | | |
|---|---|---|---|
| 1236164 | 3/1967 | Fed. Rep. of Germany | 4/502 |
| 1434647 | 10/1969 | Fed. Rep. of Germany | 4/502 |
| 2845411 | 4/1980 | Fed. Rep. of Germany | 4/502 |

*Primary Examiner*—Henry K. Artis

[57] ABSTRACT

The specification of the present application discloses a self-rolling swimming pool cover which extends when connected to a pressure source and returns to a rolled position when disconnected therefrom. The cover comprises a cover member, collapsible conduit means extending in one direction of the cover member and coil spring means extending in the same general direction as the conduit means. When a fluid pressure source is connected to the conduit means, it expands and in so doing, causes the cover to unroll from its compact state. When the pressure source is disconnected the conduit means is allowed to vent and collapse as the coil springs urge the cover to its rolled state. The cover will operate on the fluid pressure readily available from the discharge side of a circulating pump with the vented water being discharged from the rolling of the cover merely entering the pool. Therefore according to the present invention, a convenient swimming pool cover is achieved which can easily be extended or rolled within a pool.

6 Claims, 6 Drawing Figures

SELF-ROLLING SWIMMING POOL COVER

FIELD OF THE INVENTION

The present invention relates to swimming pool covers and in particular to self-rolling swimming pool covers.

BACKGROUND OF THE INVENTION

Swimming pool covers are now extensively used to reduce the entry of leaves and debris into a pool and to reduce the heat loss from the pool when not in use. A number of insulating swimming pool blankets have been proposed; however, a problem still exists due to the bulkiness thereof and the susceptability of these units to damage. Swimming pool covers to date are difficult to place over the pool and also require considerable effort to remove reducing the frequency the the pool is covered. A woman may not be capable or willing to remove a pool cover or replace the cover when she is finished with the pool because of its size and weight.

To overcome this problem, a number of mechanical arrangements have been provided which are rolled to the edge of the pool for securing the cover, to a roller with the cover then rolled to a compact state. Although this system is an improvement, it still does not provide a simple system for rolling and storing of a pool cover.

The present invention seeks to mitigate the above problems and provide a simple system for either placing the cover on a pool or allowing the removal thereof without the need for substantial physical effort by the user.

SUMMARY OF THE INVENTION

According to the present invention, a self-rolling swimming pool cover is possible which has a spring bias urging the pool cover to a fully rolled position. The pool cover is buoyant and contains collapsible conduit means extending in one direction of the pool cover and coil spring means extending in the same general direction as the conduit means, such that a pressure source may be connected to the conduit means to extend the pool cover overcoming the spring force urging the cover to the rolled position. Furthermore upon release of the pressure source, the cover member rolls upon itself due to recoiling of the spring means and venting of the conduit member to provide a compact rolled cover within the pool.

According to an aspect of the invention, the conduit means are adapted for securement to the pressurized fluid source of the pool filter system where this pressure source may be releasably connected to the swimming pool cover. As can be appreciated once the swimming pool cover has been extended, the pressure of the filter system is maintained within the conduit means to maintain the cover in place. Upon release of the pressure source, the conduit means are vented to the swimming pool allowing collapse of the conduit members and recoiling of the swimming pool cover.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
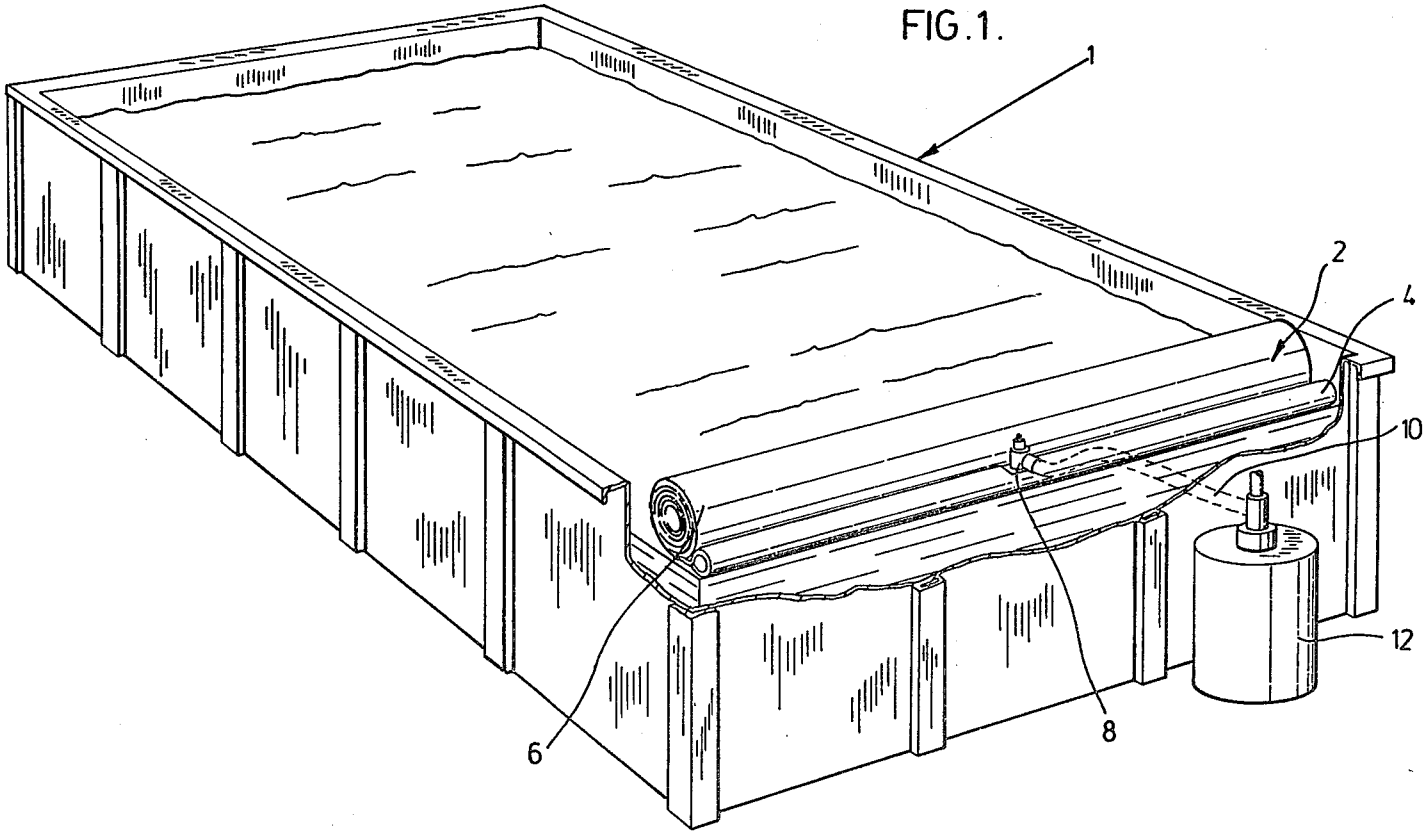
FIG. 1 is a perspective view of a swimming pool with the rolled swimming pool cover at one end thereof.

As shown in the cut-away portion of the swimming pool 1 of FIG. 1, the rolled swimming pool cover 2 has a manifold member 4 secured at one end of the cover member 6 with a fast release coupling member 8 secured to the manifold for distribution of pressurized fluid to the cover. The pressurized fluid source is provided by the filter system 12 and the flexible hose 10 which is secured to the manifold member. The position shown in FIG. 1 would be just prior to the swimming pool cover extending due to pressurized fluid entering the cover member and overcoming the spring force urging it to the rolled position.

Figure 2:
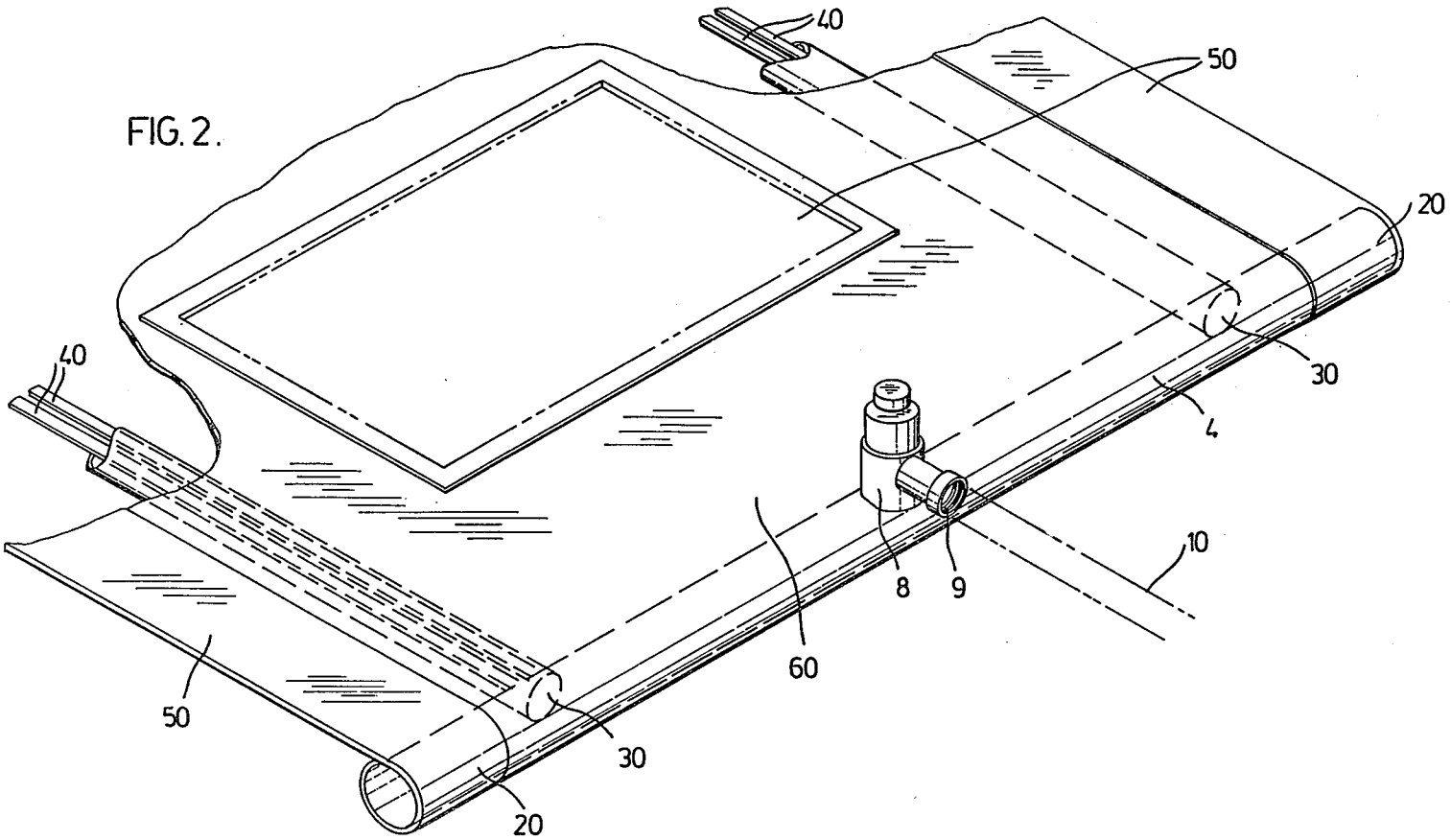
FIG. 2 is a partial perspective view of one end of the swimming pool cover in the extended position.

As can be seen in FIG. 2, the manifold is made of a plastic pipe which is secured across one end of the cover. Extending outwardly from the manifold are collapsible conduit members 30 and spring member 40 which, in this case, are shown interior to the conduit members. These conduit members are directly secured to the lower surface of the swimming pool cover, whereby the cover extends with the inflation of the conduit members and rolls with the retraction due to the spring bias caused by coil springs 40.

In rolling of the cover, the most difficult portion of the process is starting the recoiling of the spring. Once the cover starts to roll, the effective rolling force increases and there is little difficulty in continuing the rolling process. To assure both a compact rolled condition and to reduce the weight of the cover, the conduits must vent as the weight of the water within the conduits would render the system inoperative. Furthermore, this additional weight would make the removal of the cover from the pool extremely difficult. Therefore, the rolling of the cover squeezes the conduits and essentially wrings them out. In light of this, the conduits can be made quite small; however, they must be of sufficient size to cumulatively overcome the spring force. Also the conduits are preferably made of a material which collapses easily.

The cover member as shown includes thin nylon sheet material 50 and buoyant foam material 60 to assure the cover remains on the surface of the pool. At either end of the manifold 4 are buoyancy chambers 20 to support the additional weight of the conduit member and to support the quick make and break connection 8. The conduit members 30 are made of a flexible material which inflates to the generally round shape shown in FIG. 2, however, collapse to a generally flat condition when the pressure source is removed and the manifold 4 is allowed to vent either to the atmosphere or to the pool.

Figures 3, 4:
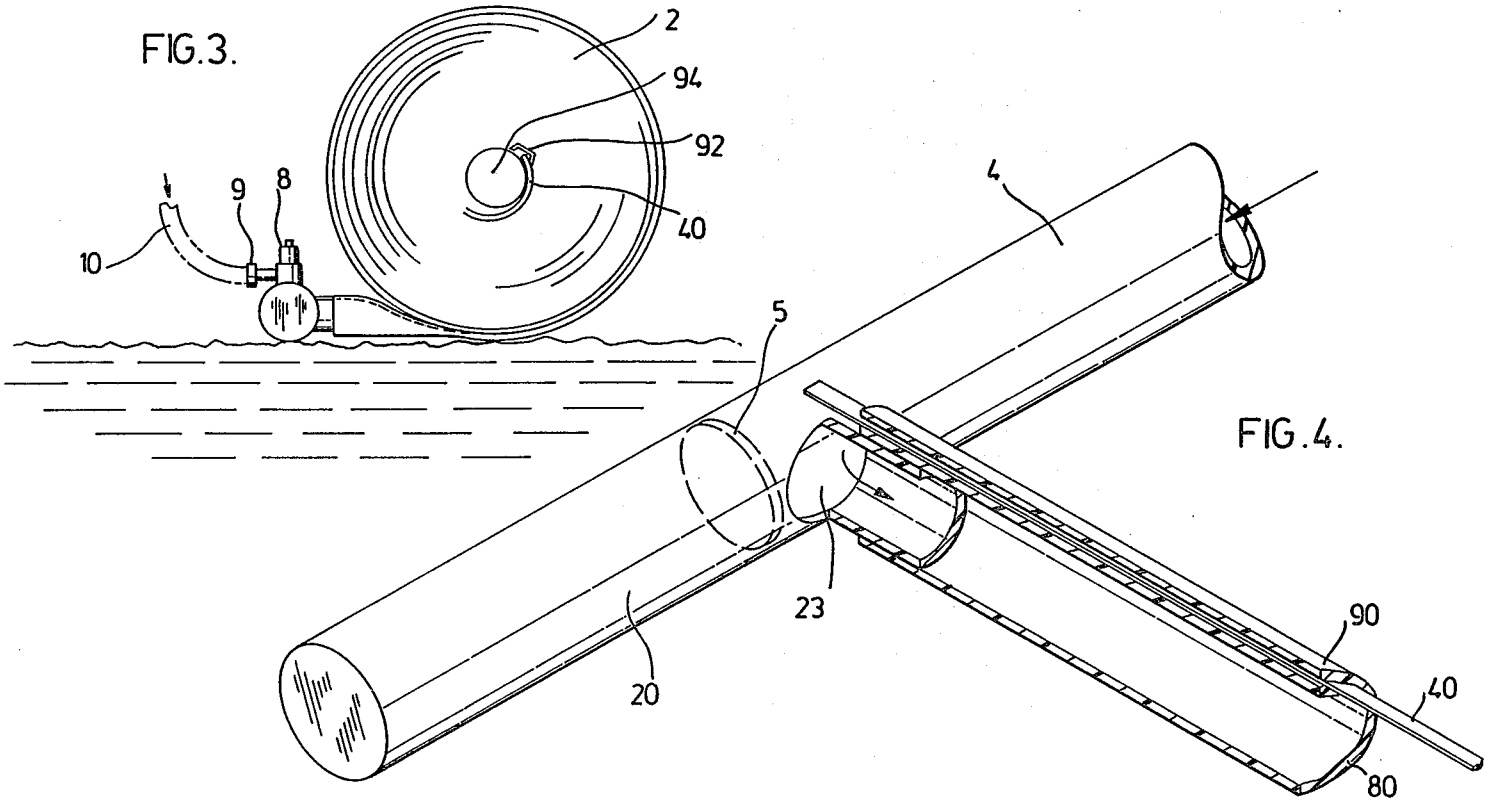
FIG. 3 is an end view of the rolled swimming pool cover.
FIG. 4 is a partial perspective view illustrating the manifold at one end of the swimming pool cover and an associated inflatable member which extends over the length of the swimming pool cover.

As shown in FIG. 4, the conduit members 30 are made of a flexible material 80 which is a water treated nylon and an upper material member 90 sandwiches the coil spring 40 between member 80 and 90. In this way, the coil spring is directly secured to the conduit members and cloth member 90 may be secured to the swimming pool cover such that the spring force or bias is directly transmitted to the cover.

The spring, due to the corrosive atmosphere within the pool, will normally be made of a stainless steel although other materials or vinyl coated steel could be used. Although it is preferred that the coil spring 40 is not prone to corrosion, this may not prove a problem if it is sealed relative to the cover.

As can be seen in FIG. 3, the swimming pool cover is shown in its compact fully rolled position with the end support member 94 at the interior of the cover. This end support member is similar to the manifold 4, however, is sealed to provide buoyancy and a more or less rigid end portion across the opposite end of the cover. The coil spring 40 has one end secured directly to support member 94 to facilitate rolling of the cover to the compact state shown in FIG. 3. The spring may be mechanically secured to member 94 by clamp members shown as 92. As can be seen, the conduit member 30 is generally flattened along the length of the pool cover to provide a very compact rolled cover when the pressure source is not connected to the manifold. Support member 94 also serves to roll the cover in a controlled manner and avoid skewing in rolling of the cover.

Figure 5:
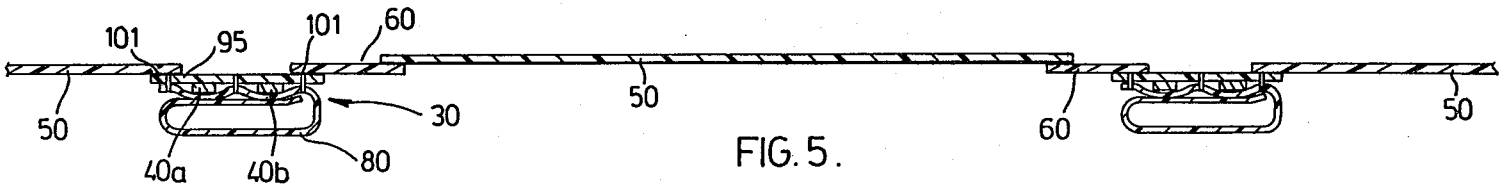
FIG. 5 is a sectional view taken through the swimming pool cover when in the deflated state.
Figure 6:
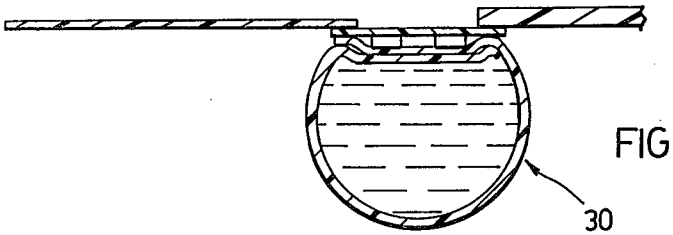
FIG. 6 is a partial cross-section of the swimming pool cover in the fully extended position.

With respect to FIGS. 5 and 6, one particular method for securing the inflatable conduit and the coil springs to the cover is shown. Two inflatable conduits and two coil spring systems are shown in the cross-section of FIG. 5 and are spaced across the width of the swimming pool cover. The nylon members 50 are quite thin and would sink if not for the floatation provided by the foam-type material 60 secured either side of the central portion and adjacent the inflatable conduits. By securing the conduits to the lower surface of the swimming pool cover reduces the amount of foam material 60 as these conduits are filled with liquid and are essentially self-supporting. If these conduits were put on the upper surface of the cover, the material 60 would have to provide additional buoyancy to avoid the cover at least partially sinking within the pool. The conduit material 80, as shown, is directly secured to material member 95 and sandwiches the two coil springs shown as 40*a* and 40*b*. These material members 80 and 95 are secured either side of the coil springs by stitching 101 to secure material member 95 and the conduit 80 to the cover. The opposite end of member 80 is then glued to itself beneath the coil springs to define the conduit, with the stitching seams 101 being isolated from the interior of the conduit. This avoids leakage of fluid from the system and represents only one way in which the coil members 40*a* and 40*b* and the flexible inflatable conduits 30 could be manufactured. These conduits return to the flattened position shown in FIG. 5 due to the rolling of the cover upon itself and the sandwiching of the conduit as the cover is rolled. The fluid within the conduit is forced rearwardly towards the manifold and vented therefrom. It is appreciated the conduits could be premade as a continuous tube.

When the pressure source is then connected to the manifold, fluid enters the conduit 30 to progressively inflate the same and cause the cover to extend down the length of the pool. The inflated conduit is shown in FIG. 6, where it has taken on a rounded shape with the pressure within the conduit being sufficient to overcome the coil spring force urging the cover to the rolled position. Although the minimum required fluid pressure for extending the cover will vary with the particular size of swimming pool cover and the number of spring systems used, approximately 6 lbs/in$^2$, which is easily available from the filter system of a pool, will force the cover to its fully extended position and allow the coil spring system to return it to the fully rolled position when the pressure source is removed.

With the present system, a self-rolling swimming pool cover is provided which only requires the connection or disconnection of a fluid pressure source to extend or retract the cover. Although the swimming pool cover shown in the drawings is made of a combination of two materials, it could be appreciated that in the case of a solar blanket, which is itself buoyant, the second material may not be necessary as the buoyancy of the blanker would be sufficient to to support the conduit and spring system. Furthermore, the securement of the conduit and the coil spring system to the blanket can be accomplished in a number of manners and is not to be limited to the structure specifically shown. For example, seamless conduits could be used which would avoid the necessity of overlapping of the conduit materials and the coil spring system could be positioned within the conduit and secured to the manifold member and the other rigid member at the opposite end of the cover. The manifold preferably has buoyancy chambers at either end thereof for support, however in the example of a solar blanket which is buoyant, this additional boyancy may not be required. The rigid member, which extends across the opposite end of the swimming pool cover, is preferred to assure the cover rolls upon itself in a controlled manner to achieve the compact rolled position of FIG. 3; however, it need not extend across the entire end of the cover. It is preferred that the springs be secured to the thinner of the two cover materials to produce a more compact rolled condition and to improve the rolling efficiency of the cover.

The swimming pool cover has been shown with a rectangular shape; however, this again is only one possibility and is not essential to the present system. In an oval shaped pool, the manifold member could be secured near one end, with the opposite end of the cover member first rolling to the center of the pool and then drawing the manifold member towards the center to allow completion of the self-rolling step.

As discussed above, the rigid members at either end of the cover may not be required in all instances; however, it should be pointed out that they assist in assuring the cover rolls in a controlled manner and simplify the removal of the cover from the pool. As can be appeciated from FIG. 1, the user merely has to grasp the cover in its center and the rigid members will provide support along the axis thereof.

Although the preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are:

1. A self rolling removable swimming pool cover comprising a buoyant cover member, collapsible conduit means extending in one direction of the pool cover and coil spring means extending in the same general direction as said conduit means to produce a force urging said cover to roll upon itself, a rigid manifold at one end of said cover connected to said conduit means, means for releasably connecting said manifold to a water pressure source to distribute water to said conduit means and overcome the force urging said cover to roll upon itself thereby extending said cover, said coil spring means being secured to said cover in a manner to provide a progressive collapse of said conduit means in a direction towards said manifold upon release of said connecting means from such water pressure source by venting of such water in said conduit means through said connecting means due to said spring force urging said cover to roll upon itself, said rigid manifold including buoyancy means to render said manifold buoyant when filled with water, said conduit means including at least two flexible tube members spaced in the width of the cover.

2. A pool cover as claimed in claim 1 wherein said buoyancy means include buoyancy chambers at either end of said manifold.

3. A pool cover as claimed in claim 1 wherein said conduit means are secured to the lower surface of said cover.

4. A pool cover as claimed in claim 1, 2 or 3 including a rigid member at the end of said cover opposite said manifold connected to said spring means to control the rolling of said cover towards said rigid manifold.

5. A pool cover as claimed in claim 1, 2 or 3 including a rigid member at the end of said cover opposite said manifold connected to said spring means to control the rolling of said cover towards said rigid manifold and wherein said rigid member is buoyant.

6. A pool cover as claimed in claim 1, 2 or 3 wherein said connecting means is connectable to the water circulating system of a pool to provide a water pressure of approximately 6 $lbs/in^2$.

* * * * *